US007963264B2

(12) United States Patent
Reynolds

(10) Patent No.: US 7,963,264 B2
(45) Date of Patent: Jun. 21, 2011

(54) ENGINE CRANKING SYSTEM AND METHOD

(75) Inventor: Michael G. Reynolds, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 405 days.

(21) Appl. No.: 12/145,633

(22) Filed: Jun. 25, 2008

(65) Prior Publication Data

US 2009/0322101 A1 Dec. 31, 2009

(51) Int. Cl.
*F02N 11/14* (2006.01)

(52) U.S. Cl. ..... 123/179.3; 290/38 R

(58) Field of Classification Search ..... 123/179.1, 123/179.3; 320/166, 167; 290/28, 38 R
See application file for complete search history.

(56) References Cited

U.S. PATENT DOCUMENTS 5,157,267 A * 10/1992 Shirata et al. ..... 290/38 R
5,818,115 A * 10/1998 Nagao ..... 290/38 R
6,325,035 B1 * 12/2001 Codina et al. ..... 123/179.1
7,319,306 B1 * 1/2008 Rydman et al. ..... 320/166

* cited by examiner

*Primary Examiner* — Stephen K Cronin
*Assistant Examiner* — Arnold Castro
(74) *Attorney, Agent, or Firm* — Quinn Law Group, PLLC

(57) ABSTRACT

A vehicle has an engine, a starter motor, an energy storage system (ESS) for powering an auxiliary system, and a supercapacitor module for powering the starter motor during engine cranking and starting. The supercapacitor module disconnects from the starter motor to recharge. A DC-DC booster converter increases the level of voltage supplied from the ESS so as to charge the supercapacitor module to a relatively higher voltage level, such as approximately 125 to 140 percent of the voltage level supplied by the ESS. A method for preventing voltage sag in an auxiliary system of the vehicle includes disconnecting the supercapacitor module from the starter motor when the engine is running, and then charging the supercapacitor module using the ESS until a cranking support voltage equals a stored target voltage. A detected commanded cranking and starting of the engine causes the connection of the supercapacitor module to the starter motor.

13 Claims, 3 Drawing Sheets

ENGINE CRANKING SYSTEM AND METHOD

TECHNICAL FIELD

The present invention relates to a system and a method for cranking and starting an engine in a vehicle.

BACKGROUND OF THE INVENTION

A conventional light-duty vehicle engine is typically started at the beginning of a trip and remains active through the duration or length of the trip. The engine starting event draws a significant amount of electrical energy or power over a relatively short period of time ranging from approximately 0.3 seconds for a warm engine, to over 2 seconds for a very cold engine. Generally, a direct current (DC) electric motor powered by a single 12-volt battery is used to start the engine. Such a motor draws maximum amount of electrical current at its stall speed, with the electrical current decreasing as the speed of the motor increases. A typical 12-volt battery provides maximum current and minimum voltage during the initial portion of the starting event.

Before the engine of a conventional vehicle is started, the auxiliary electrical loads in the vehicle are powered by the 12-volt battery. Thus, all of the auxiliary loads experience a reduced voltage supply during the initial portion of the engine starting event. In some cases, this transient voltage reduction or voltage sag can cause a potentially noticeable or perceptible change in the performance of the auxiliary loads, such as a decrease in light intensity from incandescent lighting. Once the engine starts, the engine-driven generator produces the necessary electrical power for energizing the auxiliary loads, and may also recharge the 12-volt battery.

One method of reducing fuel consumption in a conventional vehicle is to shut off the fuel supply to the engine whenever the engine is not needed for supplying propulsive power. However, this method requires repeated engine restarts during a given trip, such as each time the vehicle is stationary at a stop light between end points of the trip. Additionally, the power delivered by the engine-driven generator to the auxiliary loads will be reduced to zero as the engine is shut off. The power required for powering the auxiliary loads is supplied by the 12-volt battery or by another power source if the vehicle is so equipped.

In some vehicles, the electrical power needed for restarting the engine is provided by a second battery which powers an alternative starting motor. For example, a belted alternator/starter utilizes a combined starter/generator as a secondary engine starting device in place of a conventional engine-driven generator. By using separate batteries to provide electrical power for the auxiliary loads and the secondary engine starting device, the electrical voltage supplied to the auxiliary loads is generally unaffected during the engine starting event, generally minimizing any customer-perceptible changes in performance of the auxiliary system. However, duplicate batteries contribute significant weight while consuming valuable packaging space within the vehicle.

In other light-duty systems, a single vehicle battery and starting device are always used for starting the engine. The generator is unchanged from that of the conventional vehicle. An electronic device known as a DC-DC converter takes electrical power supplied by the battery, regardless of the battery voltage, and produces a stable DC output voltage that is supplied to specific auxiliary loads, which could otherwise exhibit a change in performance during a transient voltage fluctuation during the engine starting event.

SUMMARY OF THE INVENTION

Accordingly, a vehicle is provided having an engine, a starter motor, an energy storage system (ESS), and a supercapacitor module. When the engine is stopped, the ESS exclusively powers an auxiliary system aboard the vehicle, such as one or more sets of wipers, and/or interior/exterior lights, but the ESS itself does not exclusively power the starter motor during an engine cranking and starting event. Instead, the starter motor is initially powered at least primarily and potentially exclusively using the supercapacitor module. After the initial power for the starter motor has been drawn from the supercapacitor module, the starter motor may be connected to the ESS if conditions warrant.

To ensure proper charging and recharging of the supercapacitor module, the starter motor is connected to the supercapacitor module only during starting of the engine. Once the engine is rotating without the aid of the starter motor, the starter motor is disconnected from the supercapacitor module. One means for connecting and disconnecting the starter motor is an electrical switch, or a starter solenoid which is generally an integral part of a starter motor assembly in a conventional vehicle, although it is not necessarily so. Recharging the supercapacitor module can be accomplished at times other than during active engine starting. Charging of the supercapacitor module may be performed by the ESS, the generator, and/or another special-purpose charging device. In the event that the supercapacitor module and the ESS are both providing power to the starter motor during engine starting, there will be short periods of low current demand by the starter motor, during which the ESS may temporarily provide short term limited or partial recharging of the supercapacitor module.

One type of DC-DC converter is a boost converter. This device can be used to increase the level of voltage supplied from the ESS or from the generator to the supercapacitor module during charging, thus storing a relatively higher voltage level within the supercapacitor module than might otherwise be possible absent use of such a converter.

In a sufficiently cold ambient temperature environment, the power required to start an engine is significantly greater than the power required in a warm environment. It is possible that energy is drawn from the supercapacitor module so quickly that the voltage of the supercapacitor module drops significantly, possibly below that of the ESS before the engine has started. During this condition, the supercapacitor module can be placed in electrical parallel with the ESS using a contactor or switch when the voltage stored in the capacitor drops below a threshold during extended cranking. In one embodiment, the supercapacitor module can be charged to approximately 125 to 140 percent of the voltage level of the ESS. In another embodiment, the ESS is a 12-volt battery, and the voltage provided by the supercapacitor module prior to engine cranking and starting is approximately 15 to 17 volts. In general, the DC-DC converter can be controlled in a manner to deliver a limited amount of power to the supercapacitor module, and thus may or may not be operated during engine cranking. The appropriate type of DC-DC converter should be used depending on the voltage of the ESS, the voltage of the generator, and the voltage of the supercapacitor module.

A method for preventing voltage sag in an auxiliary system of a vehicle having an engine, a generator, a starter motor, a DC-DC converter, and an energy storage system (ESS) includes disconnecting a supercapacitor module from the starter motor when the engine is running, and then charging the supercapacitor module using the ESS, the generator, and/or the DC-DC converter until a cranking support voltage stored in the supercapacitor module equals a predetermined target voltage. If the target voltage is greater than the voltage of the ESS and the generator, then only the DC-DC converter is used to further charge the supercapacitor module above the voltage level provided by the ESS and the generator.

The method includes detecting a commanded cranking and starting of the engine, which when detected is followed by the rapid connection of the module to the starter motor. The starter motor is initially energized exclusively by the supercapacitor module for a predetermined minimum amount of time. If the engine has not started when the predetermined minimum amount of time has passed, then the voltages of supercapacitor module and the ESS are measured and compared. If the voltage of the supercapacitor module is less than the ESS, then a switch is closed to connect the supercapacitor module and the ESS in parallel. At times when the starter motor is powered exclusively by the supercapacitor module, the auxiliary system is powered only by the ESS. At times when both of the supercapacitor module and the ESS are used to power the starter motor, they both provide power to the auxiliary system.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
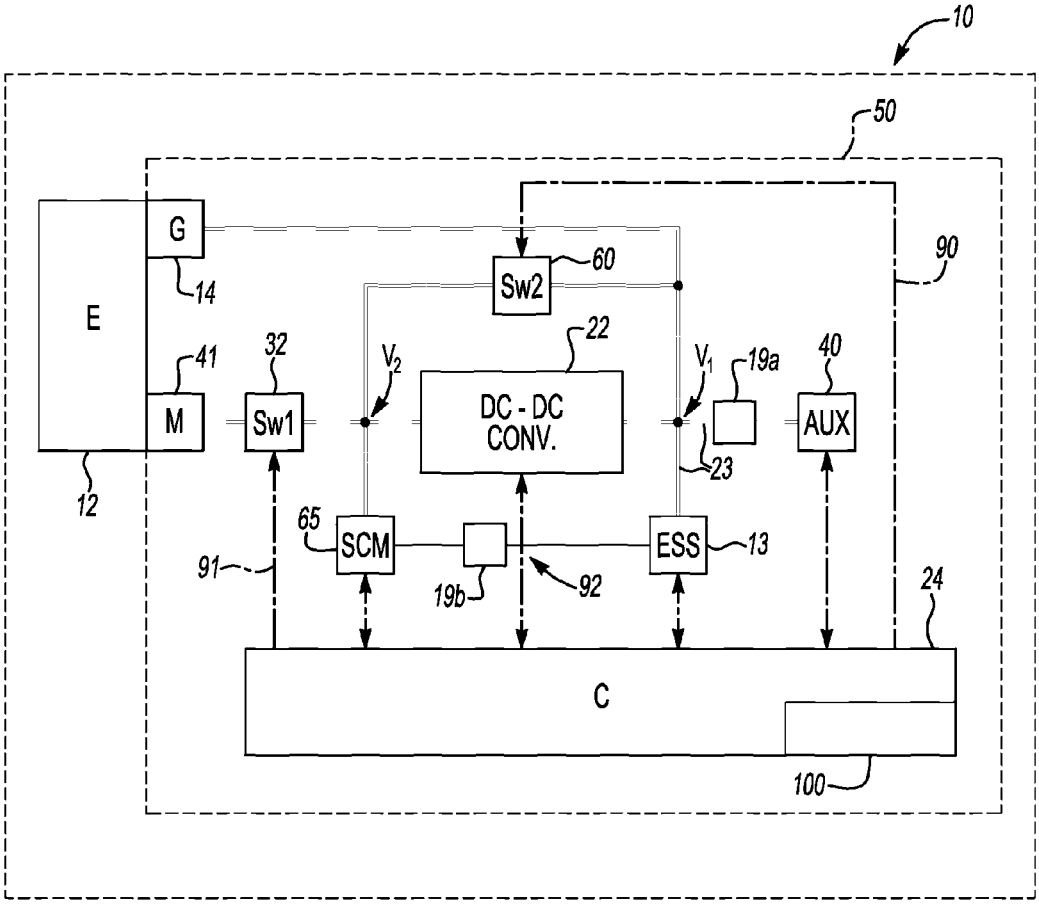
FIG. 1 is a schematic illustration of a hybrid vehicle having a supercapacitor module and a control method according to the invention.

Referring to the drawings, wherein like reference numbers refer to like components, and beginning with FIG. 1, a vehicle 10 includes an engine (E) 12 which is drivingly connected to a transmission (not shown) for propulsion of the vehicle 10. The vehicle 10 includes an electrical system 50 wherein the engine 12 is electrically connected to a starter motor (M) 41, such as a conventional DC motor of the type known in the art. The motor 41 is electrically connected to a first switch (Sw1) 32 which applies or removes electrical power from the motor 41 in response to a control signal 91 enforced or applied by an electronic control unit or controller (C) 24. The first switch 32 may be either separate or an integral part of the motor 41. If it is integral with the motor 41, the first switch 32 may or may not be capable of performing additional tasks in response to the same control signal 91 or additional signals enforced or applied by the controller 24.

The electrical system 50 further includes an energy storage system (ESS) 13 which can be configured as a rechargeable battery device or another suitable energy storage device. The ESS 13 is configured for powering or energizing one or more auxiliary systems (AUX) 40 and sensors 19*a*, 19*b*, as will be described below with reference to FIG. 2. The ESS 13 can be directly recharged using energy supplied by at least one generator (G) 14. Electrical connection for the purpose of supplying power between components, such as from the ESS and the auxiliary systems 40, is via a suitable electrical connection 23.

Within the system 50, the ESS 13 is electrically connected to a supercapacitor module (SCM) 65 via a DC-DC converter 22 of the type known in the art. Exemplary embodiments of each of the module 65 and the DC-DC converter 22 are described below with reference to FIGS. 3 and 4. The ESS 13 is also electrically connected to the generator 14. Thus, the ESS 13 directly powers the auxiliary systems 40, the sensors 19*a*, 19*b* and the DC-DC converter 22 whenever the generator 14 cannot provide sufficient electrical power, such as when the engine 12 is stopped.

When the engine 12 is running or operational, the ESS 13 and the generator 14 may each provide power to the auxiliary systems 40 and the DC-DC converter 22, or the generator 14 may exclusively provide power for the auxiliary systems 40. When the generator 14 is exclusively powering the auxiliary systems 40 and the DC-DC converter 22, the generator 14 may also be used for recharging the ESS 13. In one embodiment, a second electrical switch (Sw2) 60 is connected in electrical parallel with the DC-DC converter 22. This second switch 60 may be of the same general type as the first switch 32, and is electrically controlled to be either open or closed by a control signal 90 enforced or applied by the controller 24.

Figure 4:
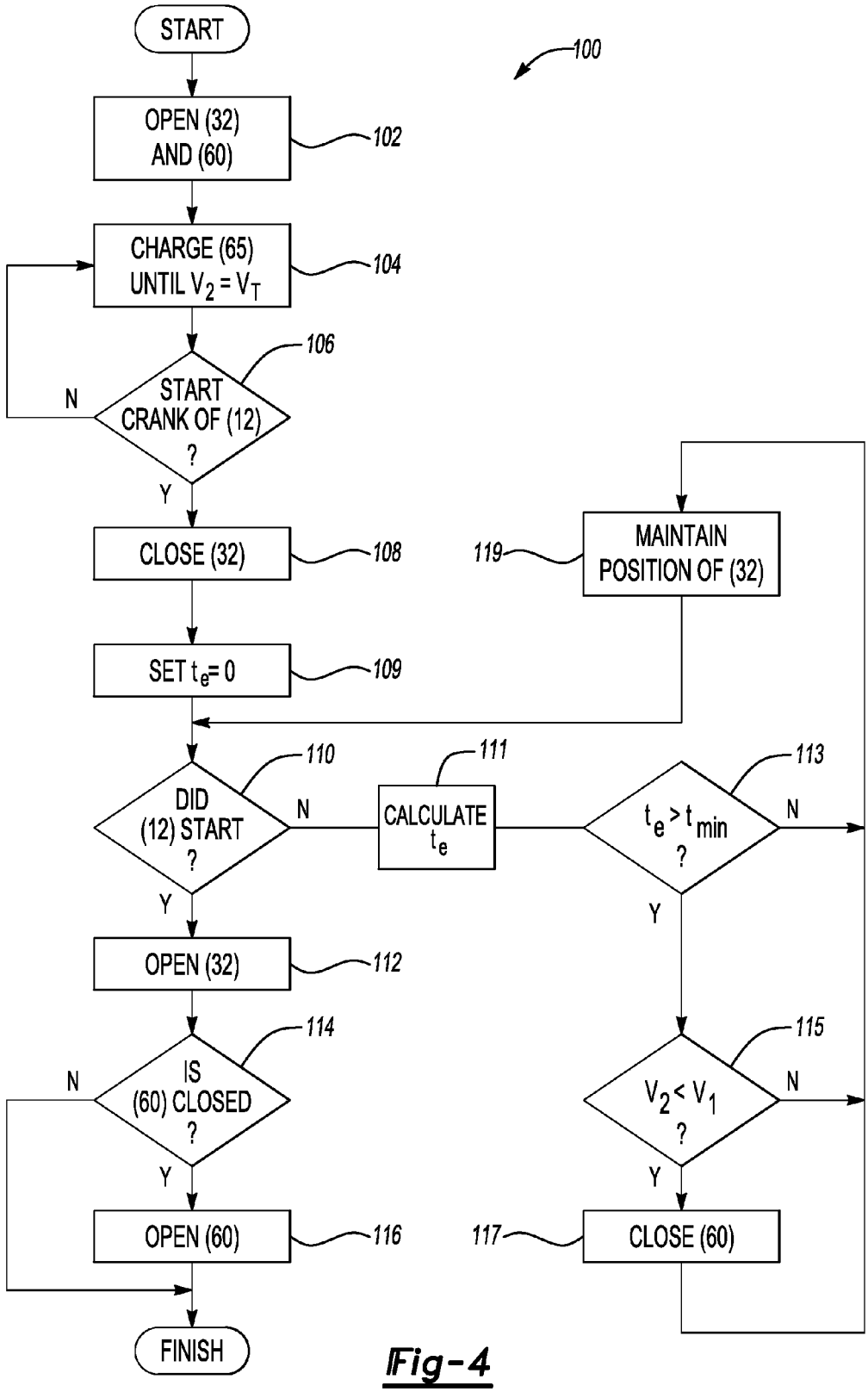
FIG. 4 is a flow chart describing one embodiment of the control method usable with the vehicle of FIG. 1.

The controller 24 includes a cranking support algorithm 100, and is in electrical communication with the first and second switches 32 and 60, respectively, the DC-DC converter 22, the engine 12 via the auxiliary systems 40, the ESS 13, and the module 65. The controller 24 can also be programmed and/or configured to include a hybrid control module, an engine control module, a transmission control module, a motor/generator control module, and/or any necessary electronic drives or power electronics circuits, as well as the algorithm 100, as described below and as shown in FIG. 4.

During the initial time period of cranking and starting of the engine 12, the controller 24 enforces the signal 91 to close the first switch 32, and does not enforce the signal 90 to close the second switch 60, thus leaving the second switch 60 in an open state or condition. The controller 24 may or may not enforce a signal 92 to the DC-DC converter 22 to selectively supply power at any chosen level from the ESS 13 to the module 65. During the initial time period of cranking, energy is drawn exclusively from the module 65 when the DC-DC converter 22 is left in an "off" state or condition. During the initial time period of cranking, energy is drawn preferentially from the module 65 when the DC-DC converter 22 is controlled in an "on" state, and when the DC-DC converter 22 supplies less than half of the power required by the motor 41.

In general, the characteristics of a DC motor that is sized appropriately for cranking a vehicle engine such as the engine 12 are such that a support voltage ($V_2$) of the module 65 is drawn lower than an auxiliary voltage ($V_1$) of the ESS 13 during the initial portion of the cranking event. Once the initial portion of the cranking event is finished and the engine 12 is rotating at an average speed that is no longer generally increasing, the support voltage $V_2$ of the module 65 may be greater than, equal to, or less than the auxiliary voltage $V_1$ of the ESS 13. With the module 65 having a sufficiently large size, and with a cranking and starting event having a sufficiently short period, all or a majority of the power utilized by the motor 41 will come from the module 65. In this case, the support voltage $V_2$ of the module 65 is reduced noticeably while the auxiliary voltage $V_1$ of the ESS 13 is reduced marginally, if at all.

In an embodiment in which the DC-DC converter 22 is a boost-type or a buck-boost-type converter of an appropriate configuration generally well-known in the art, the support voltage $V_2$ of the module 65 may be in excess of the auxiliary voltage $V_1$ prior to cranking and starting the engine 12. During later portions of the cranking event and after the cranking event, the support voltage $V_2$ may be less than the auxiliary voltage $V_1$. Ideally, the support voltage $V_2$ exclusively powers or energizes the motor 41 through the duration or interval required for fully starting the engine 12 during such normal or warm cranking conditions. However, as will be explained below, the auxiliary voltage $V_1$ can be used under certain circumstances to assist the support voltage $V_2$ as needed.

When the controller 24 determines that the cranking and starting of the engine 12 is complete, the controller 24 opens the first switch 32. Once the first switch 32 is open, the DC-DC converter 22 is allowed to recharge the module 65, i.e., one or more super-capacitive cells resident therein, to a sufficiently high voltage level. This level is referred to hereinafter as the target voltage level ($V_T$) and is described below with reference to FIG. 4. A sensor or sensors 19B such as an analog-to-digital converter, along with appropriate signal-conditioning circuitry, can be placed in electrical communication with at least the controller 24, the ESS 13, and the module 65 to thereby measure the respective auxiliary and support voltages $V_1$ and $V_2$, and to transmit or otherwise report these measurements or values to the controller 24 for use by the algorithm 100 resident therein, and/or accessible thereby.

Environmental conditions may be such that the ambient temperature and the temperature of the engine 12 may be extremely cold. In general, the time required to start a cold engine may be much longer than when the engine is warm. Likewise, the amount or level of energy required by a motor to crank a cold engine is much greater than the amount or level of energy required to start a warm engine. In these situations, the module 65 may not store sufficient energy for ensuring a successful engine start.

A provision is therefore made to allow the ESS 13 to deliver energy for starting the engine 12 once the energy level of the module 65 becomes sufficiently depleted. When conditions warrant, such as when outside temperatures and internal engine temperatures drop below the predetermined threshold temperature, which might be determined directly by sensing or measuring the outside temperature and/or the temperature of any engine coolant (not shown) using the sensor or sensors 19A, the second switch 60 is closed by the controller 24 in order to place the ESS 13 in electrical parallel with the module 65 to allow the relatively stable auxiliary voltage $V_1$ from the ESS 13 to crank the engine 12 at a maximum possible speed. Once the engine 12 has started, the second switch 60 can again be opened.

Figure 2:
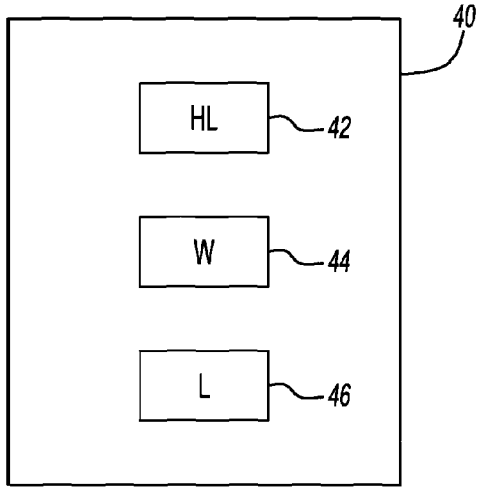
FIG. 2 is a schematic illustration of a set of representative auxiliary systems usable with the vehicle of FIG. 1.

Referring to FIG. 2, the auxiliary systems 40 of FIG. 1 include one or more electrically-powered vehicle systems powered by the ESS 13 (see FIG. 1). For example, such devices can include, but are not limited to, vehicle exterior lighting such as the headlights (HL) 42, windshield or rear window wipers (W) 44, and/or interior lights (L) 46. Lighting devices such as the headlights 42 and interior lights 46 may dim, or the wipers 44 may pause or change speeds in a perceptible manner, in response to a transient drop in the supply voltage occurring during engine cranking and starting. Therefore, the particular systems comprising the auxiliary systems 40 in a given application should include most or all of the vehicle systems known to be particularly sensitive to transient voltage sag.

Figure 3:
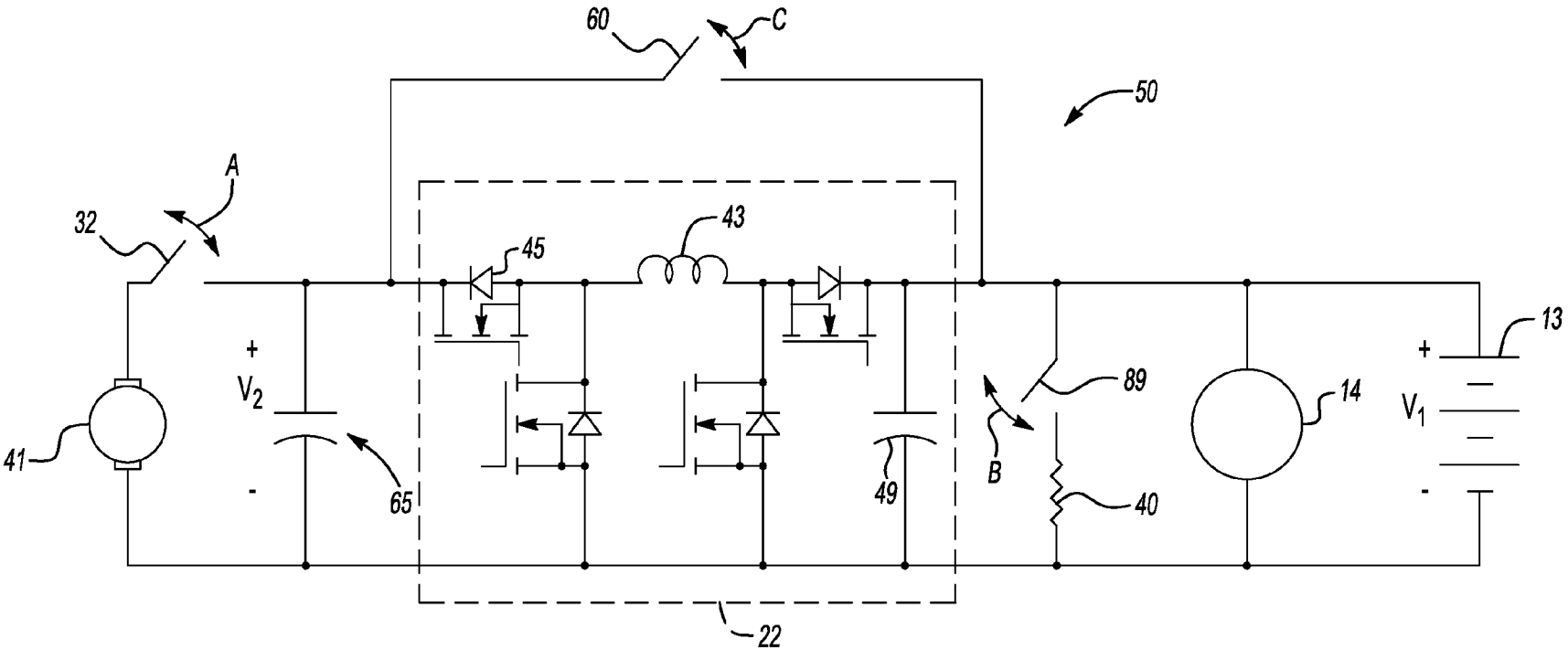
FIG. 3 is a circuit diagram for an electrical system of the vehicle of FIG. 1 according to one embodiment.

Referring to FIG. 3, one embodiment of the system 50 of FIG. 1 includes a configuration wherein the ESS 13 is connected with the generator 14 and with an electrical load, which in FIG. 1 is represented by the auxiliary systems 40. The auxiliary systems 40 can be selectively turned on or off as needed via a relay, contactor, or switch 89, as indicated by the double arrow B. The motor 41 can be selectively connected to the module 65 via the first switch 32, as indicated by the double arrow A, with the timing of the actuation of the first switch 32 being determined and controlled by the algorithm 100 of the controller 24 (see FIG. 1).

Within the module 65, one or more supercapacitor cells rapidly deliver the required support voltage $V_2$ to the motor 41 to fully crank and start the engine 12 (see FIG. 1) under normal or warm cranking conditions, as described above, without active assistance or voltage contribution from the ESS 13. Under cold cranking conditions that are less than a predetermined threshold temperature, the auxiliary voltage $V_1$ from the ESS 13 can assist the module 65 to optimize the cranking speed of the engine 12 (see FIG. 1). That is, when the outside temperature is less than a stored threshold temperature, or alternately when a target engine cranking speed is not achieved within a predetermined amount of time, or alternately when the support voltage $V_2$ of the module 65 is a predetermined voltage quantity lower than the auxiliary voltage $V_1$ from the ESS 13, the second switch 60 is closed so that the ESS 13 can assist the cranking and starting process.

As used herein, and as will be understood by those of ordinary skill in the art, a capacitor is an electronic device having a pair of conductive plates which are in turn separated or spaced by a dielectric substance or material such as glass, ceramic, cellulose, fluorocarbon, air, or another suitable dielectric material. The term "supercapacitor" in particular refers to a specialized capacitor having a high relative measure of capacitance, defined as the magnitude of a stored charge per volt, i.e., Farads. A supercapacitor can differ from a standard capacitor in a number of ways, including in its use of particular types of electrodes or plates.

For example, the electrodes of a supercapacitor might include a metal oxide, various conductive polymers, or a high surface area activated carbon material in order to provide a sufficient total capacitance. In the exemplary embodiment of FIG. 3, the total capacitance provided by the one or more supercapacitors in the module 65 is approximately 110 Farads when a 12V ESS 13 is used, with a maximum target voltage ($V_T$) of approximately 16.2 volts. However, other capacitance values and target voltages can be used within the scope of the invention depending on the desired cranking time ($t_c$)(see FIG. 4), as will be understood by those of ordinary skill in the art, such as by adding or removing any number of supercapacitor cells connected in series within the module 65, or by selecting the capacitance values of each capacitor cell within the module 65 accordingly.

The DC-DC converter 22 includes any necessary electronic circuit components needed to boost or increase the level of the auxiliary voltage $V_1$ provided by the ESS 13 in order to produce and store a sufficiently increased level of support voltage $V_2$ within the module 65. Such components can include, for example, a set of suitably configured transistors 45, e.g., a field-effect transistor such as MOSFET of the type known in the art, and/or diodes, a capacitor 49, and an inductive coil 43, as will be understood by those of ordinary skill in the art of DC-DC boost or buck-boost converters. The torque-speed envelope of any DC motor, such as the motor 41, is dependent upon the supply voltage energizing the DC motor. That is, the greater the supply voltage to the motor, the greater the amount of available torque at a given motor speed, as well as a maximum motor speed at no-load.

In the embodiment of FIG. 3, the supply voltage delivered to the motor 41 is the support voltage $V_2$, which is the auxiliary voltage $V_1$ after it has been boosted or increased by the DC-DC converter 22. The DC-DC converter 22 can be configured to provide a predetermined amount of boost, which in one embodiment is approximately 125 to 140 percent of the voltage $V_1$. For example, if the ESS 13 is capable of producing a maximum voltage $V_1$ of 12 volts, the DC-DC converter 22 can be configured to provide a support voltage $V_2$ at a higher voltage level, such as approximately 15 to 17 volts. This higher support voltage $V_2$ thus enables an increased cranking motor torque and higher motor speed at the motor 41, allowing the engine 12 (see FIG. 1) to be started in an optimal or sufficiently reduced period of time relative to that provided by the lower auxiliary voltage $V_1$.

Still referring to FIG. 3, the second switch 60 which can be opened and closed as indicated by the double arrow C can be placed between the load, such as the auxiliary systems 40, and the module 65. In this embodiment, a more efficient cold-cranking capability is provided as discussed above by allowing the closure of the second switch 60 to place the ESS 13 and the module 65 in electrical parallel. As will be understood by those of ordinary skill in the art, a voltage stored in a capacitor, such as the support voltage $V_2$ stored in module 65, drops off during extended engine cranking. Extended cranking as used herein refers to a duration or interval lasting longer than desired or expected. For example, if 300 millisecond (ms) is set as the desired or normal maximum start duration for the engine 12 (see FIG. 1), the second switch 60 can be closed or tripped if engine start has not been concluded within that interval of time, or within a desired shorter duration of time to allow time for engine cranking and starting to be completed with assistance from the ESS 13. While 300 ms is discussed above, this is only one possible embodiment, and the invention is not intended to be so limited, as other maximum start durations may be used within the scope of the invention depending on the design of the vehicle 10 (see FIG. 1).

Referring to FIG. 4, the algorithm 100 of FIG. 1 provides a method for minimizing voltage sag in the vehicle 10 (see FIG. 1) during engine cranking and starting, as described previously hereinabove. The algorithm 100 may be programmed, recorded, or otherwise stored in the controller 24, or in a location that is readily accessible by the controller 24, and is adapted for detecting or determining the presence of a predetermined operating condition indicating a commanded cranking and starting of the engine 12. In each of the following steps, the various referenced components of the vehicle 10 can be seen in FIG. 1. The initiation of a cranking and starting of the engine 12, such as would occur when an operator of vehicle 10 releases a brake pedal or depresses an accelerator pedal or other accelerator device (not shown) while the vehicle 10 is stationary and the engine 12 is turned off, acts as a predetermined signal or input condition to the controller 24, thus alerting the controller 24 to close the first switch 32 while the second switch 60 remains open.

Beginning with step 102, with the engine 12 off, the algorithm 100 ensures that the first and second switches 32 and 60 are both open, either by opening the switches 32 and 60, or by verifying that the switches 32 and 60 are already open. This may be accomplished by sending a signal or command to the switches 32 and/or 60 to open, or by sensing their position. Opening of the switches 32 and 60 includes any action which, for the first switch 32, breaks or disconnects the electrical connection between the motor 41 and the module 65, or for the second switch 60 which breaks the direct connection between the ESS 13 and the motor 41. The algorithm 100 then proceeds to step 104.

At step 104, the algorithm 100 compares the support voltage $V_2$ in the module 65 to a stored threshold or target voltage ($V_T$), and then charges the module 65 via the DC-DC converter 22 and the ESS 13 until the support voltage $V_2$ is substantially equal to the target voltage ($V_T$), i.e., within an allowable range of the target voltage ($V_T$). The target voltage ($V_T$) can be set, in one embodiment, to approximately 25 to 40 percent above the level of the ESS 13. For example, if the ESS 13 is a standard 12-volt battery, the target voltage ($V_T$) can be set to approximately 15 to 17 volts. However, those of ordinary skill in the art will recognize that other target voltages ($V_T$) can be used within the scope of the invention, depending on the particular design of the engine 12, the ESS 13, and/or the motor 41.

Additionally, the time required for charging and recharging a given capacitor of the module 65 is a function of the capacitance of each supercapacitor contained within the module 65, the stored voltage in each supercapacitor at the start of a recharge event, the current delivered by the DC-DC converter 22, and the target voltage ($V_T$) to be achieved. In equation form, $t_{charge}$=C*[Vf−Vi]/i, wherein C=total capacitance, $V_f$=final voltage, $V_i$=initial capacitor voltage, and i=the current delivered by the DC-DC converter 22 (see FIG. 1). For the exemplary embodiment in which a 110 Farad module 65 must be charged from 12 volts to a target voltage ($V_T$) of 16 volts, with the DC-DC converter 22 delivering 10 amps, the expected recharge time is 44 seconds. Regardless of the actual embodiment, when the voltage $V_2$ is determined to be substantially equal to the target voltage ($V_T$), the algorithm 100 proceeds to step 106.

At step 106, the algorithm 100 detects or otherwise determines whether an engine cranking and starting event has been presently initiated or commanded, such as by a detected depression of an accelerator pedal (not shown) within the vehicle 10. If engine cranking and starting has been initiated and detected, the algorithm 100 proceeds to step 108, otherwise algorithm 100 returns to step 104, repeating steps 104 and 106 until engine cranking has been detected.

At step 108, having determined at step 106 that engine cranking and starting have been initiated, the algorithm 100 closes the first switch 32. The second switch 60 remains in an open state. The algorithm 100 then proceeds to step 109.

At step 109, a variable $t_e$ representing the amount of time which has elapsed since the start of cranking of the engine 12 is initialized or set to zero. Afterward, the motor 41 is powered exclusively by the support voltage $V_2$ from the module 65 through the transient interval or duration required for cranking and starting the engine 12, so long as this duration is within a predetermined minimum threshold duration, or $t_{min}$. The algorithm 100 then proceeds to step 110.

At step 110, the algorithm 100 determines whether the engine 12 has started. If not, the algorithm 100 proceeds to step 111. Otherwise, the algorithm 100 proceeds to step 112.

At step 111, the present value for the elapsed time variable $t_e$ (see step 109) is calculated or otherwise determined, after which the algorithm 100 proceeds to step 113.

At step 112, the switch 32 (Sw1) is opened. The algorithm 100 then proceeds to step 114.

At step 113, the value of $t_e$ is compared to a calibrated minimum time value $t_{min}$. The algorithm 100 proceeds to step 117 when $t_e$ exceeds the calibrated minimum time value ($t_{min}$), otherwise proceeding to step 115.

At step 114, the status of the second switch 60 is checked to determine if the second switch 60 is closed. If so, the algorithm 100 proceeds to step 116. If the second switch 60 is determined to be open, the algorithm 100 is finished.

At step 115, the support voltage $V_2$ is compared to the auxiliary voltage $V_1$. If the support voltage $V_2$ exceeds the auxiliary voltage $V_1$, the algorithm 100 proceeds to step 117, otherwise the algorithm 100 proceeds to step 117.

At step 116, the second switch 60 is opened. The algorithm 100 is then finished.

At step 117, the second switch 60 is closed, and the algorithm 100 proceeds to step 119.

At step 119, the position of the switch 32 (Sw1) is maintained, and the algorithm 100 continues with step 110.

While the best modes for carrying out the invention have been described in detail, those familiar with the art to which this invention relates will recognize various alternative designs and embodiments for practicing the invention within the scope of the appended claims.

The invention claimed is:

1. A vehicle comprising:

an engine;

a motor connected to the engine, the motor being operable for selectively cranking and starting the engine;

an energy storage system (ESS) having a first voltage level;

a DC-DC converter configured to boost the first voltage level;

a supercapacitor module having a second voltage level;

a first electrical switch configured to close immediately upon detection of a commanded cranking and starting of the engine, wherein closing of the first electrical switch connects the supercapacitor module to the motor and thereby delivers the second voltage level to the motor;

a second electrical switch connected in electrical parallel with the DC-DC converter, and configured to selectively close when the second voltage level drops below a threshold during the cranking and starting of the engine, thereby placing the ESS in electrical parallel with the supercapacitor module, and thereby providing the first voltage level and the second voltage level to the motor; and wherein the supercapacitor module is chargeable to the second voltage level by the ESS when the engine is running.

2. The vehicle of claim 1, wherein the DC-to-DC converter is a boost-type or a buck-boost type converter.

3. The vehicle of claim 1, wherein the first voltage level is approximately 12 volts, the second voltage level is approximately 16 volts, and the supercapacitor module has a capacitance of approximately 110 Farads.

4. The vehicle of claim 1, wherein the ESS exclusively powers at least one auxiliary system during cranking and starting of the engine, and wherein the at least one auxiliary system is selected from the group consisting of a set of headlights, a set of windshield wipers, interior lights, and a radio.

5. An apparatus for preventing voltage sag during engine cranking and starting in a vehicle having an engine, a DC starter motor, a battery having a first voltage level, and a DC-DC converter, the apparatus comprising:

a first and a second switch, wherein the first switch is connected in series between the DC-DC converter and the starter motor, and the second switch is connected in parallel with the DC-DC converter;

a supercapacitor module which is electrically connected to the battery and adapted for providing a second voltage level for exclusively powering a cranking and starting of the engine immediately upon detection of a commanded cranking and starting of the engine; and a controller having an algorithm for selectively opening and closing the first and the second switches;

wherein closing the first switch connects the supercapacitor module to the starter motor to thereby allow the supercapacitor module to deliver the second voltage level to the starter motor, thereby cranking and starting the engine exclusively using the second voltage level without delaying the cranking and starting; and wherein closing the second switch connects the battery to the starter motor when the second voltage level drops below a threshold during the cranking and starting of the engine, thereby placing the battery in electrical parallel with the supercapacitor module, thereby cranking and starting the engine using at least the first voltage level.

6. The apparatus of claim 5, wherein the apparatus includes the DC-DC converter which is electrically connected to each of the battery and the supercapacitor module for charging the supercapacitor module to the second voltage level, the second voltage level being at a level that is higher than the first voltage level.

7. The apparatus of claim 6, wherein the battery is a 12-volt battery, and wherein the second voltage level is approximately 15 to 17 volts.

8. The apparatus of claim 6, wherein a closing of the second switch places the ESS in electrical parallel with the supercapacitor module to thereby enable the ESS to assist the supercapacitor module in the cranking and starting of the engine.

9. A method for preventing voltage sag in an auxiliary system of a vehicle having an engine, a starter motor, a DC-DC converter, an energy storage system (ESS) having a first voltage, and a supercapacitor module electrically connectable to the ESS, the method comprising:

disconnecting the supercapacitor module from the starter motor when the engine is running by opening a first switch in series between the DC-DC converter and the starter motor;

charging the supercapacitor module by opening a second switch in electrical parallel with the DC-DC converter, such that a second voltage stored by the supercapacitor module approaches a stored target voltage;

detecting a commanded cranking and starting of the engine; and immediately connecting the supercapacitor module to the starter motor by closing the first switch when the commanded cranking and starting of the engine is detected, thereby delivering the second voltage to the starter motor to power the cranking and starting of the engine.

10. The method of claim 9, further comprising:

detecting an engine temperature; and using the second voltage and the first voltage to crank and start the engine when the engine temperature exceeds a stored threshold temperature.

11. The method of claim 10, further comprising:

detecting a cranking time; and using the second voltage and the first voltage to crank and start the engine when the cranking time exceeds a stored threshold cranking time.

12. The method of claim 10, further comprising:

setting a stored target voltage equal to approximately 125 to 140 percent of the first voltage; and using a DC-to-DC booster converter to boost the first voltage to a level equal to the stored target voltage.

13. The method of claim 12, further comprising:

configuring the ESS as a 12-volt battery; and setting the stored target voltage equal to approximately 15 to 17 volts.

* * * * *